US008794247B2

(12) United States Patent
Kulik

(10) Patent No.: US 8,794,247 B2
(45) Date of Patent: Aug. 5, 2014

(54) APPLICATOR DEVICE, IN PARTICULAR FOR A MASCARA APPLICATOR, COSMETICS APPLICATOR, IN PARTICULAR MASCARA APPLICATOR COMPRISING AN APPLICATOR DEVICE, AND APPLICATION UNIT COMPRISING THE APPLICATOR DEVICE

(75) Inventor: Daniela Kulik, Leipzig (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 13/337,883

(22) Filed: Dec. 27, 2011

(65) Prior Publication Data

US 2012/0192892 A1 Aug. 2, 2012

(30) Foreign Application Priority Data

Dec. 30, 2010 (DE) ..... 20 2010 017 159 U

(51) Int. Cl.

| | |
|---|---|
| ***A45D 40/26*** | (2006.01) |
| ***A46D 1/00*** | (2006.01) |
| ***A45B 11/00*** | (2006.01) |
| ***A46B 9/02*** | (2006.01) |
| ***A46B 9/06*** | (2006.01) |

(52) U.S. Cl.

CPC ..... *A46B 9/021* (2013.01); *A46B 9/025* (2013.01); *A46B 9/06* (2013.01); *A46D 1/0253* (2013.01)

USPC ..... 132/218; 132/320; 15/207.2; 401/129

(58) Field of Classification Search

CPC ..... A46B 9/02; A46B 9/021; A46B 9/025; A46B 2200/1046; A46B 2200/1053; A46B 2200/106; A46D 1/0253; A46D 1/0238; A45D 34/042; A45D 40/262

USPC ..... 132/218, 219, 216, 107, 159, 160, 161, 132/317, 318, 320, 901, 148, 313; 401/126, 401/121, 128, 129, 130, 9, 261; D28/7, 21, D28/36; 15/206, 207, 207.2

See application file for complete search history.

(56) References Cited

U.S. PATENT DOCUMENTS

| | | | | | |
|---|---|---|---|---|---|
| D68,282 | S | * | 9/1925 | Van Ecker | D28/21 |
| 1,880,619 | A | * | 10/1932 | Wildey | 607/79 |
| 4,561,456 | A | * | 12/1985 | Gueret | 132/218 |
| 4,964,429 | A | * | 10/1990 | Cole | 132/218 |
| 5,716,150 | A | * | 2/1998 | Gueret | 401/129 |
| 6,067,997 | A | * | 5/2000 | Gueret | 132/218 |
| 6,343,607 | B1 | * | 2/2002 | Gueret | 132/218 |

(Continued)

FOREIGN PATENT DOCUMENTS

| | | | | |
|---|---|---|---|---|
| DE | 602004000935 T2 | | 1/2007 | |
| WO | 97/28719 A1 | | 8/1997 | |
| WO | WO 2006039575 A1 | * | 4/2006 | A46B 1/00 |

*Primary Examiner* — Vanitha Elgart

(74) *Attorney, Agent, or Firm* — Setter Roche LLP

(57) ABSTRACT

The invention relates to an applicator device, in particular for a mascara applicator, having a core from which application organs extend. The applicator device can be produced using a primary forming process in which, at least in some portions, the application organs are disposed in a longitudinal extent in rows, as viewed along a longitudinal axis of the core, and comprise a central axis. The central axis of the application organs have at least one undulation with at least one change of curvature, and the central axis of an application organ lies completely or substantially completely within one plane or spanning a plane.

17 Claims, 9 Drawing Sheets

(56) References Cited

U.S. PATENT DOCUMENTS

| | | | | |
|---|---|---|---|---|
| 6,470,897 | B1 * | 10/2002 | Jung et al. | 132/218 |
| 6,575,174 | B2 * | 6/2003 | Lee | 132/160 |
| 6,581,610 | B1 * | 6/2003 | Gueret | 132/218 |
| 6,866,046 | B2 * | 3/2005 | Gueret | 132/218 |
| 8,091,566 | B2 * | 1/2012 | Salciarini | 132/320 |
| 8,136,536 | B2 * | 3/2012 | Bickford | 132/218 |
| 2001/0035191 | A1 * | 11/2001 | Lee | 132/160 |
| 2003/0213498 | A1 * | 11/2003 | Gueret | 132/218 |
| 2005/0034740 | A1 * | 2/2005 | Eckers et al. | 132/218 |
| 2005/0196220 | A1 * | 9/2005 | Gueret | 401/129 |
| 2005/0236008 | A9 * | 10/2005 | Gueret | 132/218 |
| 2007/0193600 | A1 * | 8/2007 | Garofano et al. | 132/218 |
| 2008/0184512 | A1 * | 8/2008 | Gueret | 15/206 |
| 2009/0214284 | A1 * | 8/2009 | Gueret | 401/121 |
| 2010/0071715 | A1 * | 3/2010 | Bickford | 132/218 |
| 2011/0168204 | A1 * | 7/2011 | Gueret | 132/218 |

* cited by examiner

APPLICATOR DEVICE, IN PARTICULAR FOR A MASCARA APPLICATOR, COSMETICS APPLICATOR, IN PARTICULAR MASCARA APPLICATOR COMPRISING AN APPLICATOR DEVICE, AND APPLICATION UNIT COMPRISING THE APPLICATOR DEVICE

FIELD OF THE INVENTION

The invention relates to an applicator device, an applicator comprising the applicator device and an application unit comprising the applicator device.

BACKGROUND OF THE INVENTION

A cosmetics applicator comprising bristles which may have an undulation is known from DE 60 2004 000 935 T2. This document relates to both nail polish application devices, e.g. nail polish brushes, and to cosmetics applicators, e.g. mascara applicators. Furthermore, the production of these bristles together with a core of the applicator by injection molding is known. The stated object of such an application device is, if possible, to enable cosmetic products with different viscosities to be applied in a satisfactory manner.

A combing device for applying eyelash make-up comprising curved bristles is known from WO 97/28719. These curved bristles are disposed in the form of a single row on the core of the applicator, or provided in the form of exactly two opposite bristle rows extending in a rotationally or mirror-symmetric manner.

This device is disadvantageous in that, due to the merely limited number of application elements, an often insufficient quantity of mascara fluid for application to the eyelashes is available on the applicator. Furthermore, the user has to constantly pay attention when using such an applicator that the applicator is at a favorable angle to the eyelash to be charged. This means that the user often has to bring the applicator into a position suitable for applying mascara in an undesired manner by rotation about the longitudinal axis of the applicator.

It is the object of the invention to propose an applicator device which is suitable for forming a cosmetics applicator, in particular for applying mascara. In particular, the mass storage capacity for cosmetic mass is supposed to be improved, and sufficient mascara mass is supposed to remain on the applicator despite a wiping process which is usually carried out when the cosmetics applicator is pulled out of a mascara container. In the process, the mascara mass is supposed to be distributed on the applicator device as uniformly as possible. In particular, it is to be ensured that, after the wiping process, the mascara mass is kept in a radially inner area, i.e. in an area in the vicinity of the core, whereas free ends of the application organs are supposed to contain an as exactly dosed mascara quantity as possible. In other words, it is therefore an object of the invention to make available a defined mascara mass reservoir in the area of the core of the applicator device.

Furthermore, the applicator device is supposed to be suitable to ensure that the eyelashes are wetted all-around with mascara mass as extensively as possible, and to ensure a curling effect by means of a clamping action of the eyelashes between the application organs of the applicator device.

It is another object of the invention, in particular in a special embodiment, to provide for the all-round wetting of eyelashes with mascara mass in a particularly effective manner. It is another object of the invention to produce the applicator according to the invention in a particularly cost-effective and highly reproducible manner in which high accuracy with regard to the arrangement and shape of the bristles is ensured.

Not least, it is an object of the invention to propose an applicator which in the un-wetted state is aesthetically pleasing and which has a spectacular appearance and a striking design in a certain way.

It is another object of the invention to provide different application characteristics, e.g. a separating or bundling effect of varying strength, as well as a separating and combing behavior of the applicator relative to the eyelashes that is developed in varying degrees.

SUMMARY OF THE INVENTION

The aforementioned objects are achieved with an applicator device, in particular for a mascara applicator, comprising a core from which application organs extend radially in a ray-like manner. In this case, the applicator device is produced using a primary forming process, in particular formed integrally as a plastic part, and characterized in that at least in some portions the application organs are disposed longitudinally in rows, seen along a longitudinal axis of the core, and comprise a central axis, the central axis of the application organs having at least one undulation with a change of curvature, and the central axis of an application organ lying completely within one plane or spanning a plane.

A primary forming process within the sense of the invention is understood to be the fabrication of a solid body from an amorphous substance. According to DIN 8580, primary forming processes include all production methods in which a solid body is produced from an amorphous substance. According to the invention, this includes all production methods from the area of plastic injection molding, and in particular also a production method in the form of a 3D printing process in which an applicator device is produced from an amorphous mass by means of 3D printers. Expressly not included in the primary forming processes is the production of an applicator device in the form of a constructed, i.e. assembled applicator device comprising a wire core and prefabricated bristles retained by it. Furthermore, a primary forming process, according to the invention, is also understood not to include a bristle manufacturing process in which prefabricated bristles are later inserted into a prefabricated core.

The primary forming processes according to the invention should be understood to include, in particular, one-, two- or multi-component injection molding processes, in particular also using different plastic raw materials. Applicator devices produced in this way can be joined in assembly with further components, e.g. an applicator stem or the like, with conventional assembly methods. In particular, the invention includes an applicator device in which the core, for example, is configured to be hollow and can be plugged, glued or otherwise mounted on a carrier pin produced from another material.

In this case, it may be advantageous that the applicator device is divided into at least two areas along its longitudinal direction, with the areas differing either with regard to the geometries of the core of the applicator device or with regard to the application organs, be it with respect to their three-dimensional shape or their arrangement or other design. Thus, the applicator device according to a preferred embodiment of the invention has a first area with application organs or with a core of a first type and a second area with application organs or with a core of a second type. Thus, different applicator types can be successfully adapted to a large extent to the requirements of the user in a simple manner by variation of the core geometry and also of the application organ geometry or type.

According to a particularly preferred embodiment, the central axes of application elements of one row are disposed in a common plane, with the plane optionally being disposed parallel to a longitudinal axis of the applicator device, in particular including the longitudinal axis. Such an arrangement of undulating application organs relative to the core of the applicator device considerably facilitates demolding, particularly in the production method of plastic injection molding.

According to a particularly preferred embodiment, the application elements disposed in a ray-like manner, viewed in the circumferential direction, are disposed in such a way that central axes of application elements of two rows, respectively, which are opposite from each other relative to the core, lie in a common plane.

In particular for the purpose of producing reservoir volumes for the mascara mass, it may be provided that the undulations of the central axes of application elements of adjacent rows are configured in an inverse manner.

A particularly uniform mass storage and application behavior is achieved if the undulations of the central axes of the application organs of all undulated application organs is configured identically, i.e. identically with regard to an amplitude, a wave length, an orientation and/or the curvature profile. Therefore, the entire application organ covering of the applicator or of at least one of the areas of the applicator is constructed from identical application elements, which guarantees, in particular, a uniform distribution of the mass storage and application properties over the area comprising such application elements. This particularly applies if the undulated application organs are all configured identically.

In order to form an applicator which conically tapers towards the free (distal) end of the applicator, the core is configured to taper conically, and in this case, the bristle covering of the first and second areas, in particular also the geometric three-dimensional shape of the application organs, may be identical because the conical configuration of the applicator towards the free end is ensured by a conicity of the core.

Conversely, it may of course also be expedient that, in order for the applicator to be configured conically towards the distal end, the core, in an end portion of the applicator, e.g. in a second area, is configured identically to the first area, i.e. configured cylindrically or is continued, with an application organ covering of a second type being provided in the second area that has no undulation and in which the radial longitudinal extent of the application organs decreases in a direction away from the core towards the distal end of the applicator.

In the case of a cylindrical core, an applicator can be provided in a simple manner which, as a result of the variation of the length of the application organs (given a conical configuration), a reduction of the length of the application organs tapers conically towards the end. Moreover, application organs that become shorter towards the free end have a different bending characteristic and are in particular configured less flexible, so that positive effects become evident also in this case with regard to the separation and combing effect of the eyelashes.

In different embodiments of the invention the application organs in the second area may, for example, be conical bristles, discs, disc portions, teeth or the like.

In particular with regard to the wiping result on a wiper of a cosmetics/mascara unit, it has proved advantageous to dispose undulated application organs relative to the core in such a way that free ends of the undulated application organs point towards the distal end of the applicator. Such an arrangement of the application organs in particular facilitates wiping off mascara mass in the area of the free ends of the application organs, because they can be easily pulled through the wiping means in particular without getting caught in it, and can be bent well towards the core.

Nevertheless, a considerable reservoir volume for mascara mass, which is then available unaltered during application as well as after wiping, is obtained in the base area or in the area of the application organs closer to the core, in particular if they are configured slightly thicker there.

A particularly high storage capacity with regard to the mascara mass adhering to the applicator is obtained if the application organs of a first row are disposed offset in the longitudinal direction of the applicator relative to application organs of adjacent rows. This property can be provided so as to be distributed particularly uniformly over the surface of the core if they are disposed offset in such a way that the application elements of the one row are disposed approximately centrally between the free gaps of second application organs of another, adjacent row.

In order to form different applicators, the applicator device can be configured in such a way that the application organs of the first area have an undulation and the application organs of the second area are not undulated but curved once.

According to another advantageous embodiment of the invention, the application organs are formed from a different, in particular softer, plastic than the core. This embodiment can be produced well in particular with the two component injection molding process.

Preferred geometric dimensions of the application elements are characterized in that tangents on the central axes of undulated application organs include in the base area of the application elements an angle $\alpha$ to the longitudinal axis of the applicator, with an angle range of $30° \leq \alpha \leq 90°$, in particular $50° \leq \alpha \leq 70°$, having proved itself.

In the case of undulated application organs, it may moreover be provided that tangents T include in the point of inflection W of the central longitudinal axis L an angle $\beta$ or $\beta'$ to the longitudinal axis of the applicator, where the following preferably applies:

$0° \leq \beta \leq 90°$, in particular $25° \leq \beta \leq 75°$ or $0° \leq \beta' \leq 90°$, in particular $25° \leq \beta' \leq 75°$ or $\alpha \neq \beta$ or $\alpha \neq \beta'$ $\beta < \alpha$ or $\beta' < \alpha$.

Furthermore, it is advantageous that the application organs are configured to taper, in particular in a pointed manner, from the base of the application organs towards the free ends of the application organs. A relatively stiff application element base area can thus be obtained which bends little during wiping, so that reservoir volume for mascara mass is made available in a sufficient extent.

Of course, the application organs of the second type may be conical bristles, teeth, discs, annular discs or disc segments or furrows.

It may be advantageous, in particular in order to improve the all-round wetting of eyelashes, that convex areas of the curved application organs of adjacent rows, seen in a side view, touch each other or are spaced from each other at most by a distance that is less than a diameter of an eyelash to be charged with mascara. In this manner, a clamping effect is obtained by means of application organs which, though spaced from each other, nevertheless almost touch, seen in a side view, and thus, the eyelash is gripped on both sides by application organs so that an almost complete wetting over 360° can take place. Such a clamping effect, by means of the application organs clampingly gripping and clampingly sliding along the eyelashes, also causes a desired curling effect, i.e. a bending of the eyelashes during the application of the mascara mass.

If application elements with curved application organ sections facing each other convexly are provided, there is the option of disposing the application organs of adjacent rows closer to each other in the longitudinal direction of the applicator than the application organs of adjacent rows that face each other with their concavely curved sections. It is thus accomplished that two application organs, respectively, of adjacent rows form a corresponding application organ pair which has convexly curved section facing each other for improved wetting of the eyelashes with mascara.

The corresponding application organ pairs are preferably disposed in the circumferential direction around the core of the applicator in rows, with an imaginary central plane between the application organs forming the respectively corresponding application organ pairs preferably standing perpendicularly on the longitudinal axis of the applicator. In this manner, it is ensured, due to a collection effect of the application organs of an application organ pair, that a plurality of eyelashes is captured and that an optimum bundling of the eyelashes can thus take place.

This is ensured in particular by the free ends of the application organs forming an application organ pair in that case expediently pointing in different directions relative to the longitudinal axis of the applicator. For example, this can be designed in such a way that a free end of a first application organ points towards the distal end, whereas the second free end of the second application organ points towards the handle section of the applicator, i.e. towards a proximal end of the applicator.

Similarly, the object of the invention is achieved by an applicator, in particular a cosmetics applicator, which comprises an applicator device according to the invention.

Moreover, the invention also includes an applicator unit, in particular a cosmetics unit, comprising an applicator device according to the invention. Such cosmetics units usually comprise a container for cosmetics, in particular for mascara mass, and a handle section, which on the one hand is connected to the applicator device and on the other hand most frequently serves as a screw-on cap for the container. Moreover, a wiper means can of course be provided in the neck region of a container.

On the whole, it is particularly advantageous in the invention that on the one hand, visually particularly attractive and spectacular, flame-like applicators can be produced, which are visually clearly distinct from applicators that are already known, and which are of high quality. On the other hand, by cleverly arranging the application elements, an applicator can be obtained which is more variable in the lateral area and which is adaptable to the intended area of use, and in particular, the wiping result can be positively influenced to a special extent by means of application organs that are configured in an undulated manner and arranged in an aligned way. Moreover, a high load of the applicator with mascara can be ensured, because there is, at least in the base areas of the application organs of an applicator according to the invention, a lot of room for mascara mass which can be reliably retained in reservoir volumes or reservoir areas.

The invention is explained in more detail below by way of example with reference to the drawings.

DETAILED DESCRIPTION OF THE PREFERRED EMBODIMENTS

Figure 1:
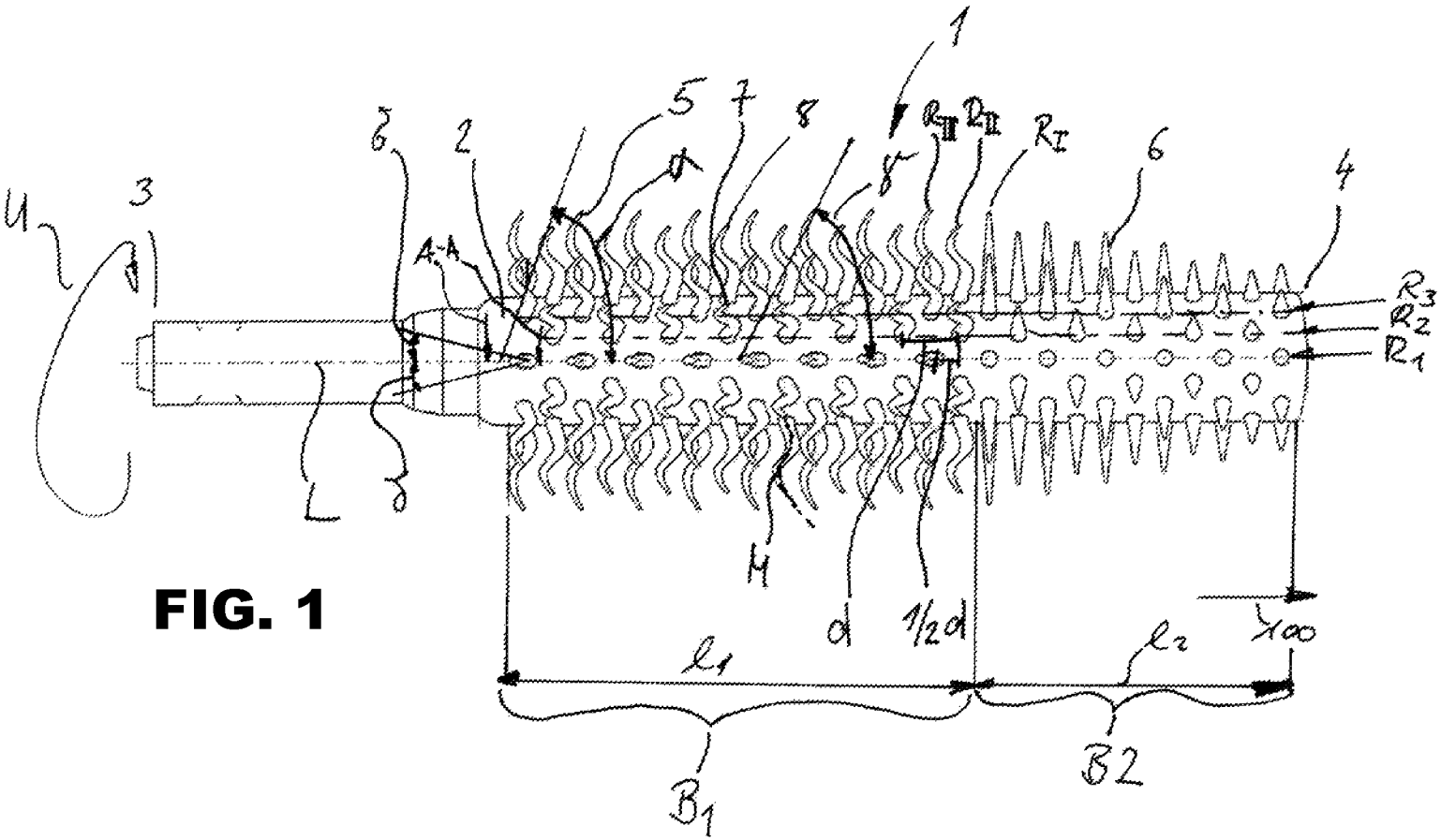
FIG. 1 shows a first embodiment of an applicator device according to the invention in a top view.

A first embodiment of an applicator device 1 according to the invention is shown in FIG. 1. The applicator device 1 comprises a core 2 as well as a proximal end 3 and a distal end 4. The proximal end 3 is configured in the conventional manner for disposing the applicator device 1 on an applicator stem (not shown). Moreover, a handling unit, for example a screw-on cap of a cosmetics unit (not shown) is disposed on this applicator stem. The distal end 4 is a free end. The core 3, just as the applicator device 1 as a whole, has a longitudinal axis L which at least in the exemplary embodiment according to FIG. 1 is the axis of symmetry of the applicator device.

The applicator device 1 has a first area $B_1$ with application organs 5 of a first type and a second area $B_2$ with application organs 6 of a second type. The application organs 5 of the first type are configured as undulated bristles 5 which are explained in more detail below. By way of example, the application organs 6 of the second type are configured as bristles that protrude substantially conically from the core 2 in a radial direction.

The applicator device 1 is formed integrally by means of a primary forming process as, for example, an injection-molded article or as a 3D-printed article from one and the same plastic, or also in a two- or multi-component process from two or more different plastics, with the core 2 preferably being formed from a harder plastic and the application organs 5, 6 from a softer plastic. In the areas $B_1$ and $B_2$, the core 2 is continuously configured as a cylinder; in order to form the applicator device 1 so as to conically taper towards the distal end 4, the application organs 6 are formed so as to become shorter towards the free end, so that an enveloping surface spanned by the application organs 6 tapers conically towards the distal end 4. The application organs 6 are configured as straight bristles.

Of course, the core 2 may also have other geometrical three-dimensional shapes. As a modification of this embodiment, the core 2 may, for example, also have a ball-like three-dimensional shape, i.e. a three-dimensional shape curved concavely outwards, or a constricted three-dimensional shape, i.e. a three-dimensional shape that extends concavely inwards. Furthermore, the core 2 may also be configured cylindrically and stepped section-wise along its longitudinal extent.

The undulated application organs 5, hereinafter referred to as undulated bristles 5, each have a bristle base 7 and a free bristle end 8. In the exemplary embodiment according to FIG. 1, the application organs 5 are configured in such a way that all free bristle ends 8 point in the direction towards the distal end 4. The application organs 5 and the application organs 6 are each disposed in rows $R_1$, $R_2$, $R_3$ . . . $R_n$ along a longitudinal direction 100 which is oriented parallel to the longitudinal axis L. Seen in the circumferential direction U, the application organs 5 and 6 are also disposed in rows $R_I$, $R_{II}$, $R_{II}$ . . . $R_{xx}$. The application organs 5, 6 substantially protrude in a ray-like manner radially from the core 2. In the area of the bristle bases 7, two longitudinal directions 100 of adjacent bristles have a longitudinal distance d between the bristle bases, with the distance d being in each case configured as a penetrating point of a central axis M described below of an application organ through an outer face of the core 2. The distance d is defined between two such penetrating points in the longitudinal direction 100.

The application organs 5, 6 of two adjacent rows $R_1$ and $R_2$ are disposed offset by the distance ½ d in the longitudinal direction 100.

It goes without saying that the above-described row-like arrangement does not necessarily have to be realized for both types of application organ types 5, 6 on an applicator device. For example, only the application organs 5 of the type 1 may be disposed offset in the longitudinal direction, whereas this need not apply necessarily also to the application organs of the second type 6, and vice versa.

The above-described arrangements of the application organs of the type 1 and the type 2 in rows in the longitudinal direction 100 as well as in the circumferential direction are analogously applicable to the other exemplary embodiments—even if not described anymore in detail below.

Each of the application organs (bristles) 5 departs the outer face of the core 2 inclined at an angle α towards the free end 4. For reasons of simplification, the angle α is drawn in relative to the longitudinal axis L in FIG. 1 et seqq. The free ends 8 of the bristles 5 are inclined at an angle γ against the outer face of the core 2 or against the longitudinal axis L and also point towards the free end 4, as was already described.

An axial longitudinal extent in the longitudinal direction 100 of the area $B_1$ with an application organ covering of application organs 5 of the first type is more than half of the total length of the areas $B_1$ and $B_2$ which comprise an application organ covering. In particular, the axial longitudinal extent $l_1$ of the area $B_1$ is 50% to 70% of the total length of the applicator device 1 comprising the bristle covering.

The area $B_2$ extends over an axial longitudinal extent $l_2$, which is correspondingly smaller.

The bristles 5 are configured to be undulated, i.e. they have a central axis M which has at least in a single point or area the curvature 0, and wherein this point is a point of inflection or the area is an area of inflection, up to which a curvature is provided in a first direction, and starting from which a curvature in a second direction is provided. Curvature within the sense of the invention is also supposed to mean that there may be a bit of a straight course of the central axis M (area of inflection) around a point of inflection. Such a bristle profile would in that case have the curvature 0. The important thing is that, in the case of an undulated bristle 5 according to the invention, the direction of curvature of the central axis M changes at least once along the central axis M.

Figure 2:
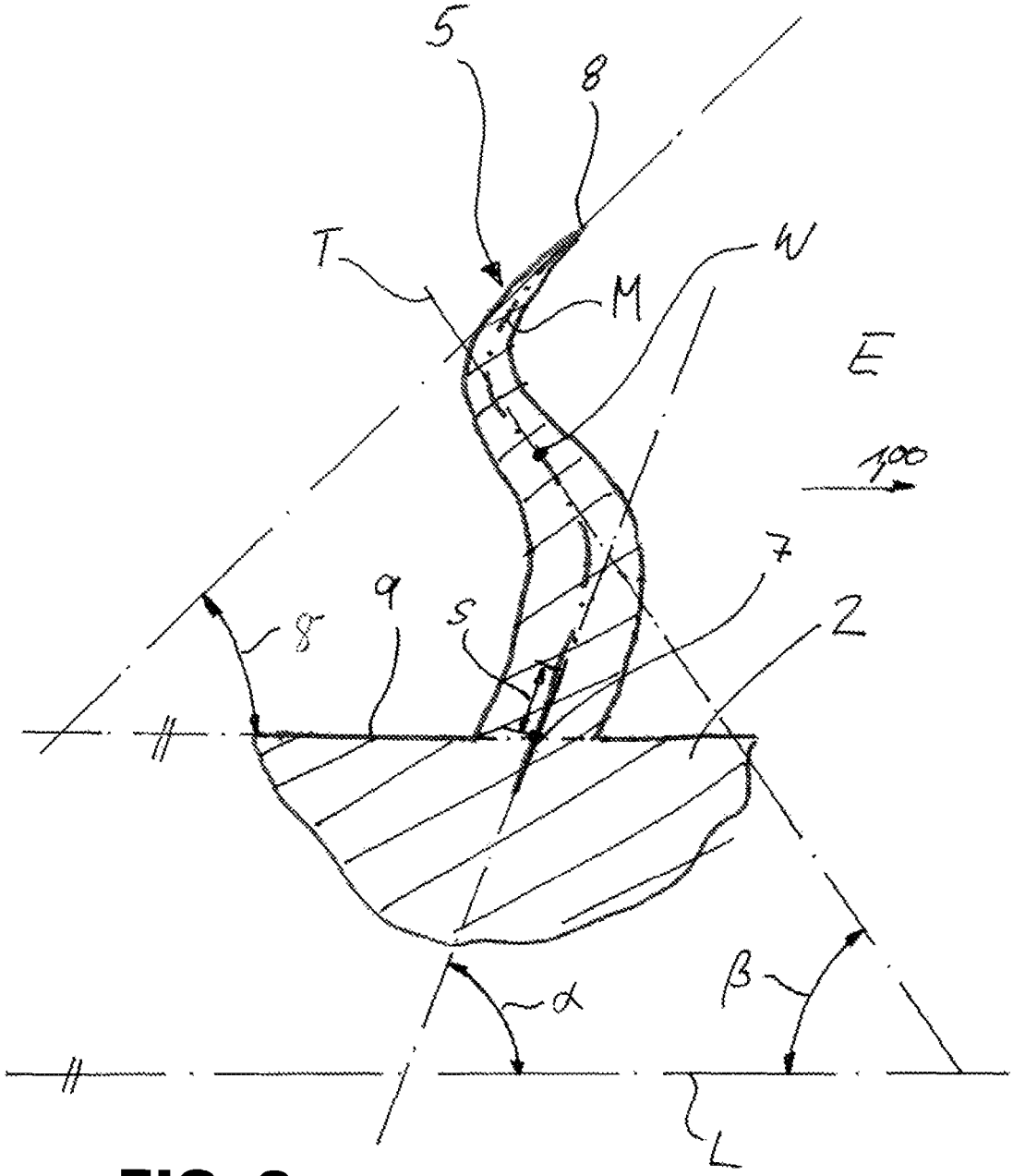
FIG. 2 shows an enlarged detailed sectional view along the line A-A from FIG. 1 of an application organ of the applicator device according to the invention.

In addition, the bristles 5 are undulated in such a way that the central axis M of a bristle 5 spans a plane or lies in a plane. This means that each bristle 5 is undulated two-dimensionally, i.e. the undulation is disposed within a single plane. This plane E, which in the following FIG. 2 is the sectional plane A-A, in this case preferably extends exactly parallel to the longitudinal axis L. However, this plane E (sectional plane A-A) may also be oriented substantially parallel to the longitudinal axis L, with substantially parallel meaning, according to the invention, that an angular deflection of the plane E by an angle δ of up to +/−10° relative to the longitudinal axis may take place. As a result, this means that though the central axis M still lies in a plane, this plane E may be disposed inclined relative to the longitudinal direction 100, so that the free ends 8 of the application organs 5 also do not point directly to the free end 4, but twisted obliquely relative thereto by the angle δ.

Alternatively or additionally, the central axes M may at least partially extend also outside the plane E (A-A) and thus cause a three-dimensionally curved configuration of the application organs 5 to a small extent, if and as far as is possible from a production engineering standpoint. Thus, the invention is expressly not limited only to application organs 5 curved two-dimensionally in a plane but, within the limits of manufacturability, also comprises three-dimensionally curved undulated application organs 5. The production engineering limits are in this case set in particular by the injection molding method with which the applicator devices are preferably to be manufactured, in particular with regard to the mold construction of the injection mold. It is particularly preferred to configure all the application organs 5 of type 1 to be as similar as possible with regard to their application organ geometry, so that a flame-like and shimmering appearance that looks particularly spectacular is produced in the case of the applicator device according to the invention comprising undulated application organs 5. This visual impression may in particular be enhanced by using a dark plastic, e.g. a black plastic, for example for the core, with the application organs 5, and optionally also the application organs 6, being formed from a red, yellow or orange plastic, at least from a plastic of a different color. This spectacular visual impression becomes noticeable particularly when the applicator device 1 of a mascara set is sold with the applicator device 1 located outside of the container and is presented so as to be clearly visible for the buyer, in blister packaging.

Furthermore, the application organs 5, just as the application organs 6, have a greater thickness preferably in the area of the bristle base 7 and taper towards the bristle end 8. The application organs 5, 6, in particular the application organs 5, may have, in any cross section perpendicular to the central axis M, a circular, oval or also triangular or polygonal cross section. A polygonal cross section with furrows, grooves or the like along the profile of an application organ 5, 6 in the area of the outer face is also conceivable.

An application organ 5 comprising an undulation is described in more detail with reference to the FIGS. 2, 2*a*. The longitudinal direction 100 is represented as the direction of the double-headed arrow in these Figures in order to illustrate that the angle values for the angles α, β, δ in each case also apply mutatis mutandis to arrangements of the application organs in a position rotated by 180° on the core 2. The application organ 5 according to the FIG. 2 is shown enlarged in a sectional plane E along the line A-A from FIG. 1. In the area of the bristle base 7, the application organ 5 protrudes at an angle α from a top side 9 of the core 2. In the exemplary embodiment according to FIG. 2, a section through an applicator device 1 configured as a single component is shown for reasons of simplification. This merely serves for illustrating the geometrical conditions. Of course, the drawing according to FIG. 2 does not constitute any limitation with regard to the choice of material or choice of production method. The bristles 5 and 6 may of course also consist of a different material than the core, as described above.

The free bristle end 8 of a bristle 5 is inclined at an angle γ to the longitudinal axis L. The application organ 5 comprises the central axis M, which is formed by the two-dimensional centers of gravity of sections through the bristle 5 along its longitudinal course from the bristle base 7 to the bristle end 8. At at least one location, the central axis M has a point of inflection W in whose vicinity the curvature of the central axis M changes. A tangent T through the point of inflection W intersects the longitudinal axis L at an angle β. Values of 30° to 90°, in particular values of 50° to 70° have proved beneficial for the angle α. Values in the range of 0° to 90°, in particular between 25° and 75° have proved beneficial for the angle β. Preferably, the angle γ is smaller than or equal to the angle α and lies in the range of between 10° and 90°, in particular between 40° and 70°.

The course of the central axis M away from the bristle base 7 may also be straight at least in parts; for example, the curvature may be 0 over a line segment s which extends for a bit for example from the bristle base 7, i.e. the central axis M forms a straight piece. Preferably, an application organ 5 according to the applicator device according to the invention has a point of inflection W, so that a curvature with a first sign is provided along the course, for example, from the bristle base 7 to the point of inflection W, and a curvature with an opposite sign is provided from the point of inflection W to the bristle end 8.

Preferably, the central axis M of the application organ 5 is less strongly curved in the area between the bristle base 7 and the point of inflection W than in the area between the point of inflection W and the free bristle end 8. The curvature may respectively be constant or change continuously or optionally abruptly in the areas between the bristle base 7 and the point of inflection W and/or in the area between the point of inflection W and the free bristle end 8. It is particularly preferred if the change of the curvature from a first sign to the opposite sign is continuous, i.e. without abrupt changes of curvature radius, in particular in area around the point of inflection W.

Figure 2A:
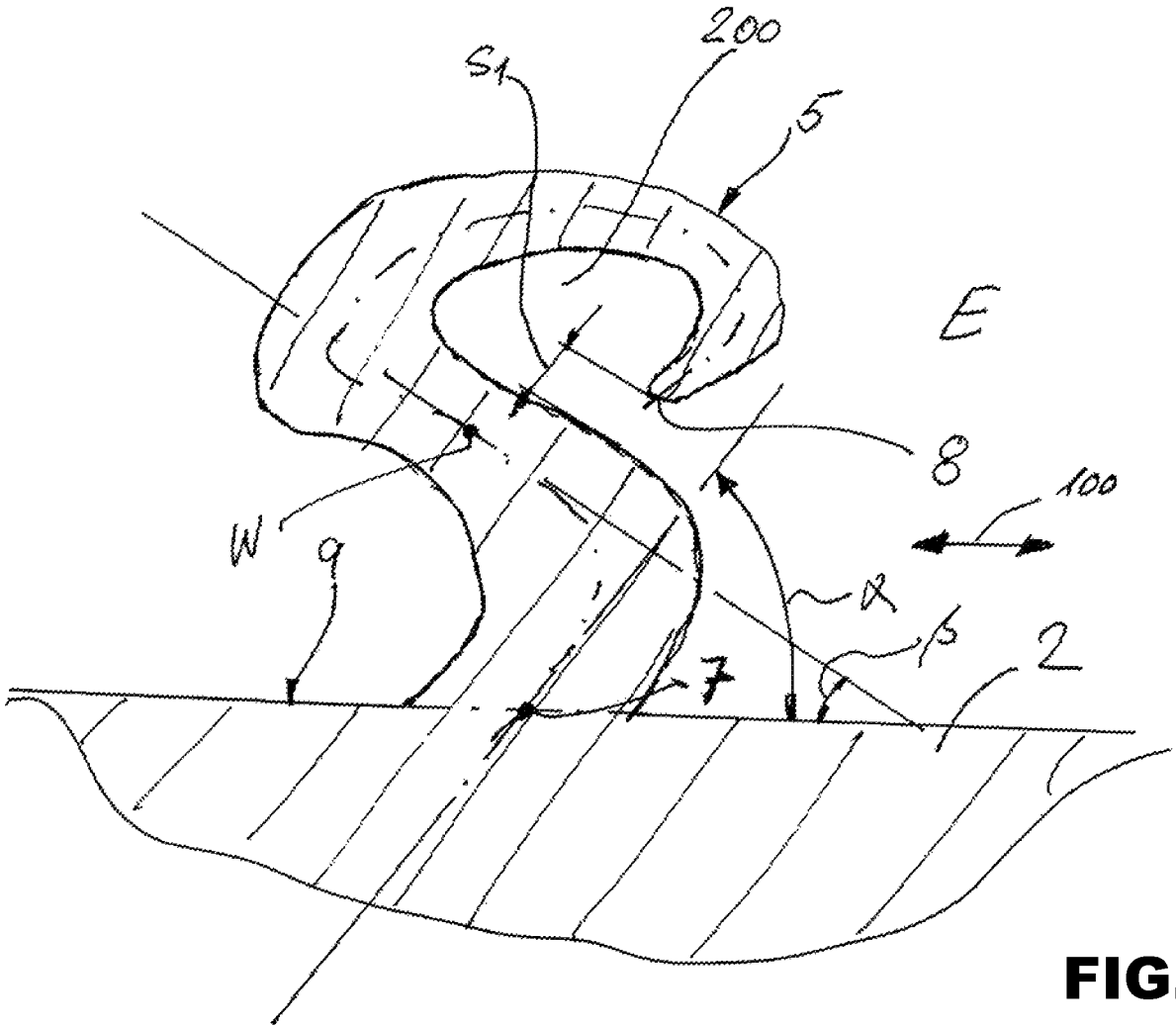
FIG. 2*a* shows an enlarged detailed sectional view along the line A-A from FIG. 1 of a second embodiment of an application organ of the applicator device according to the invention.

FIG. 2*a* shows another embodiment of an application organ of the applicator device according to the invention. In contrast to the above-described application organ 5 according to FIG. 2, the free end 8 of the application organ according to FIG. 2*a* is configured to point towards the core 2 and forms a gap $S_1$ towards the application organ 5. An eyelet, an eyelet-like loop 200 is thus formed which may optionally serve as a mascara mass reservoir more distant from the core 2. Through the gap $S_1$, at least individual eyelashes may enter the loop 200 during the application of mascara mass for which a particularly good result can be achieved with regard to all-round wetting. Depending on the selection of the size of the gap $S_1$, which may preferably be a few tenths up to a few millimeters, for example 0.1 mm to 2 mm, in particular 0.1 mm to 1.0 mm, it may also be ensured that bundles of eyelashes may optionally enter the loop 200. In this case, a special bundling effect can be achieved.

Figure 2B:
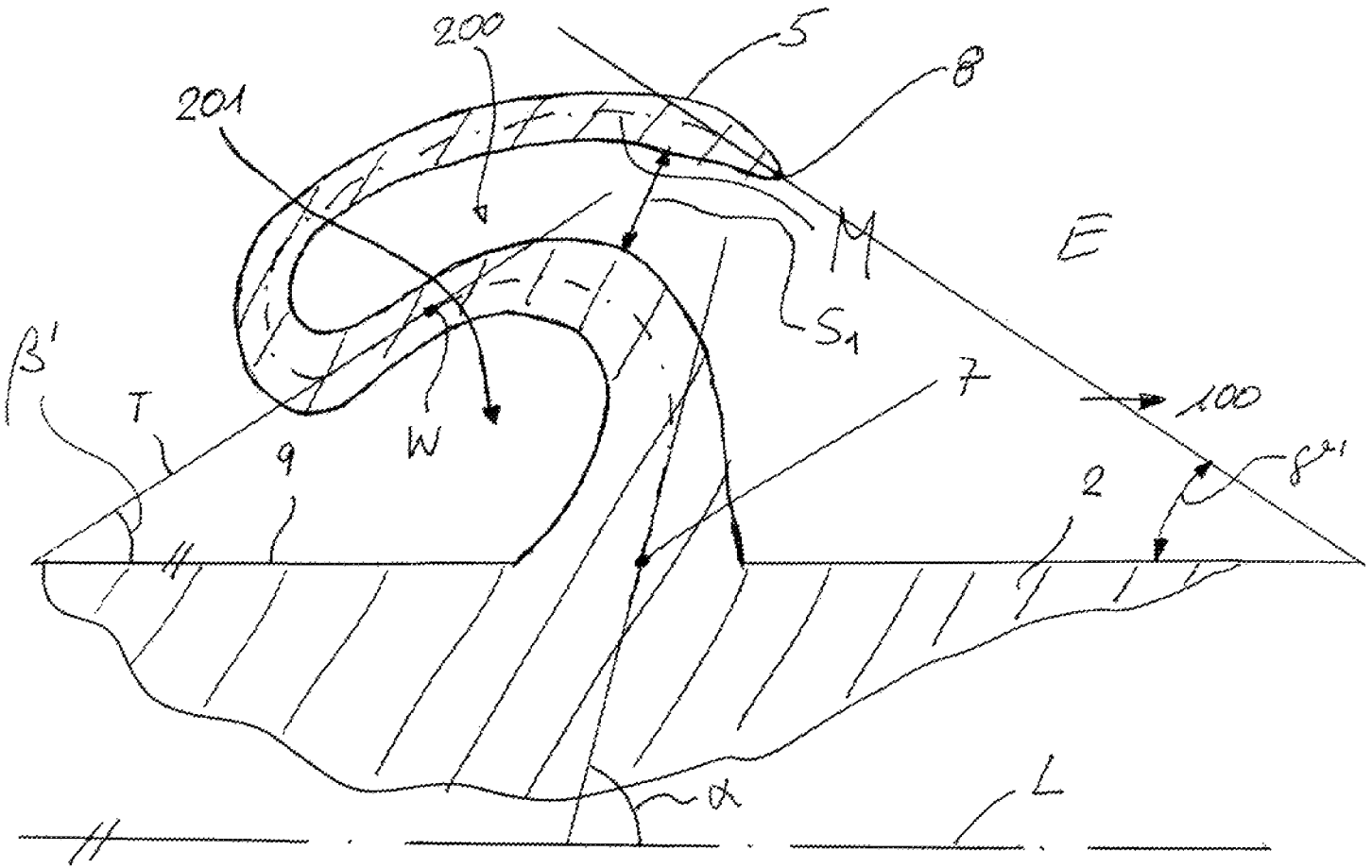
FIG. 2*b* shows an enlarged detailed sectional view along the line A-A from FIG. 1 of a third embodiment of an application organ of the applicator device according to the invention.

FIG. 2*b* shows another embodiment of an application organ of the applicator device according to the invention. The tangent T through the point of inflection W includes with the longitudinal axis L an angle β', with the angle β' being in the range of between 0° and 90°, in particular between 25° and 75°.

In the embodiment according to FIG. 2*b*, the angle γ' corresponds to the angle γ from FIG. 1 and is disposed in a minor-inverted manner relative thereto.

Suitable and preferred values of the angle γ' are in the range of between 10° and 90°, in particular between 40° and 70°.

With this design, it is possible to provide, in addition to the mascara reservoir of the loop 200, another mascara reservoir 201 closer to the core, over which the application organ 5 cantilevers in a roof-like manner.

Further exemplary embodiments of the applicator device according to the invention are explained below with reference to the FIGS. 3 to 7*a*. However, only the differences to the embodiment according to the FIGS. 1 and 2 will be referred to in detail. Thus, previously described and common features of the following embodiments apply to all embodiments mutatis mutandis.

Figure 3:
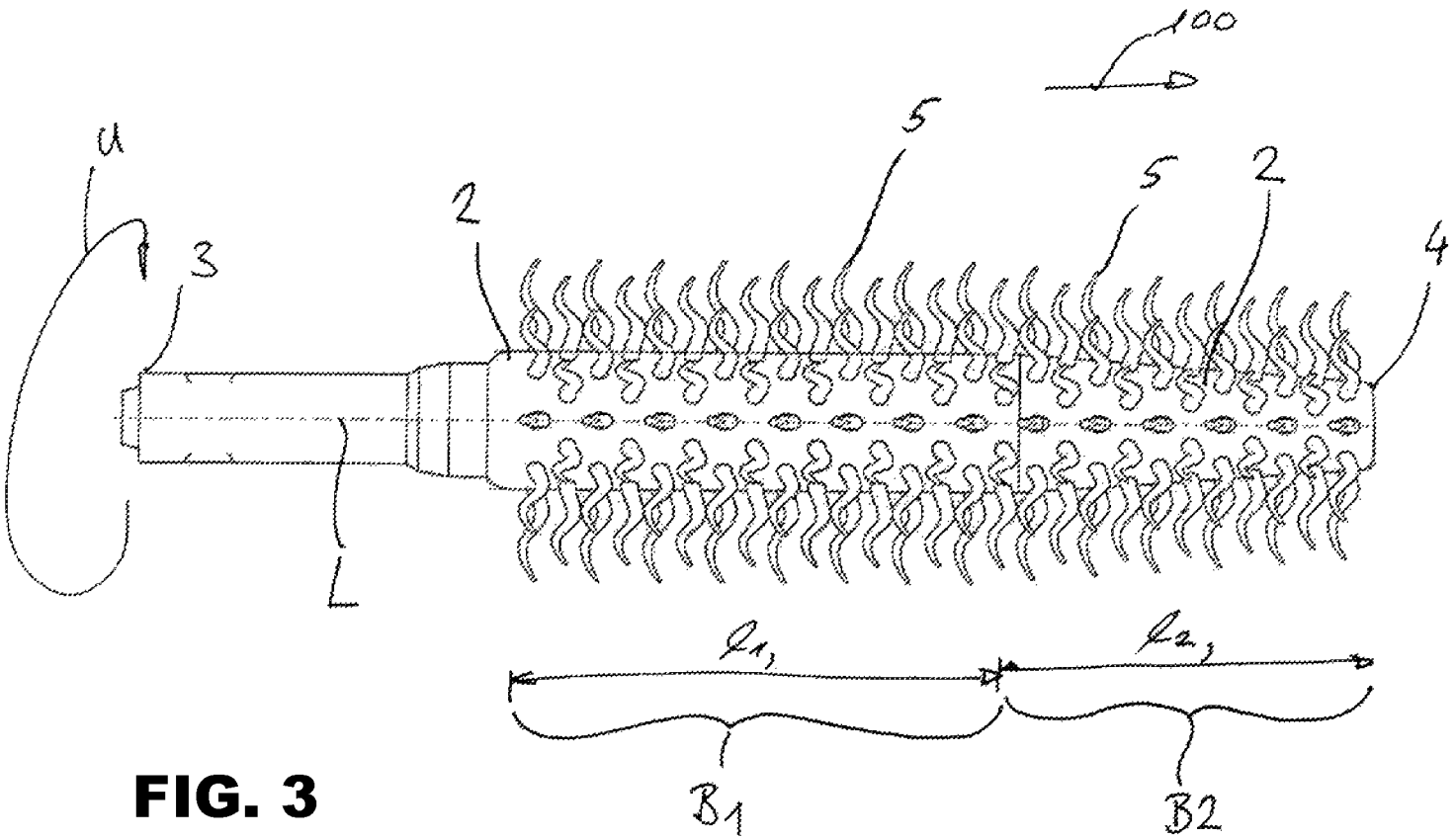
FIG. 3 shows a second embodiment of the applicator device according to the invention in a top view.

The applicator device 1 according to FIG. 3 constitutes another embodiment and differs from the embodiment according to FIG. 1 by the core 2 being configured in area $B_2$ to taper conically towards the distal end 4. In contrast, the core 3 is formed cylindrically in the area $B_1$. The application organ covering of the applicator device 1 according to FIG. 3 is of the type 1 all over, so that all application organs are undulated bristles 5 that preferably have identical geometrical three-dimensional shapes among themselves. Due to the fact that the core tapers conically in the area $B_2$, the applicator device 1 may as a whole be configured to taper conically towards the free end 4 even though the application organs 5, i.e. the undulated bristles 5, all have the same three-dimensional shape. The statements in connection with FIGS. 1 and 2 regarding the bristle geometry apply mutatis mutandis in the case of this embodiment. As do the specifications of length and distance of the rows $R_1$, $R_2$, $R_3$ and $R_I$, $R_{II}$, $R_{III}$ as well as the lengths $l_1$, $l_2$ and d and s.

Figure 4:
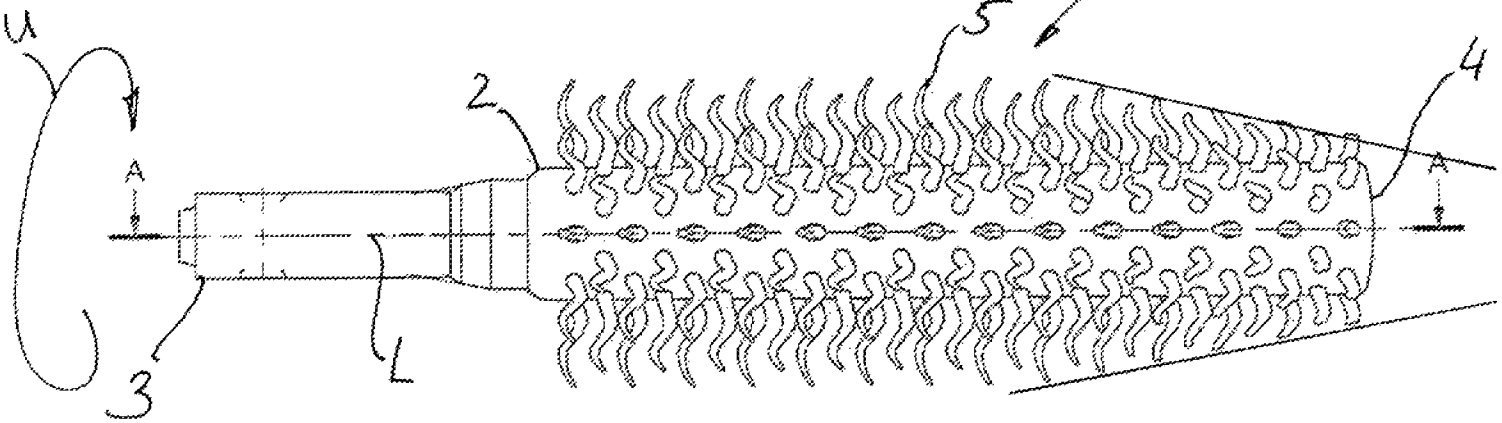
FIG. 4 shows a third embodiment of the applicator device according to the invention in a top view.
Figure 4A:
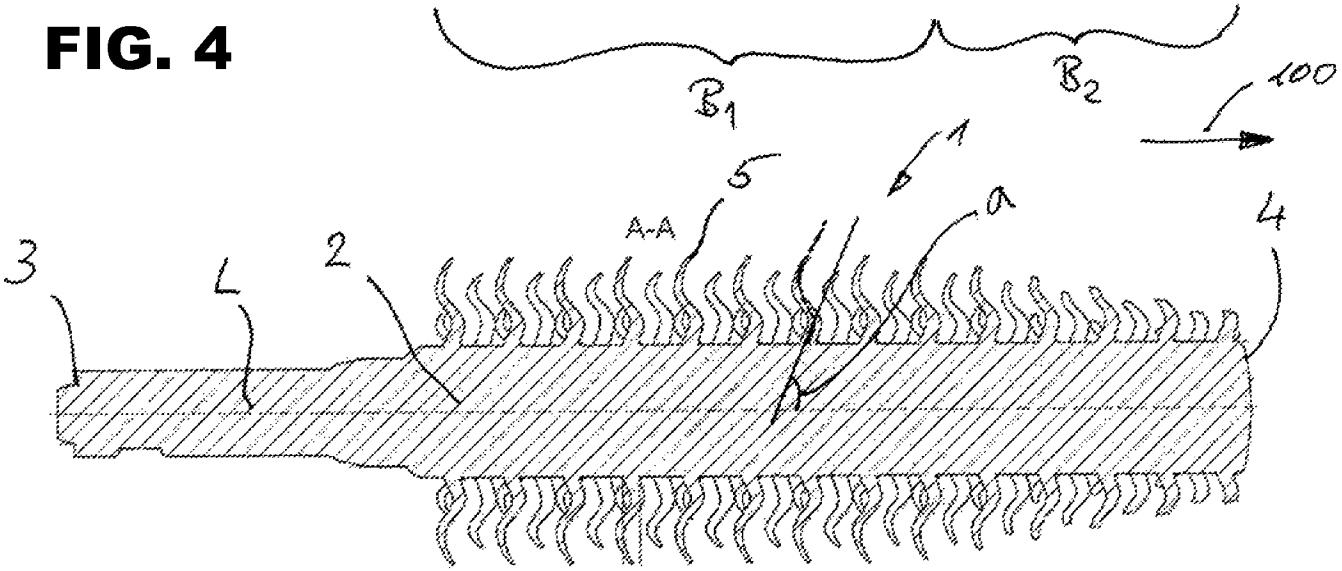
FIG. 4*a* shows the applicator device according to FIG. 4 in a longitudinal sectional view along the line A-A from FIG. 4.

FIGS. 4, 4*a* show another embodiment of the applicator device 1 according to the invention, with FIG. 4*a* showing the applicator device according to FIG. 4 in a longitudinal sectional view.

In this embodiment, the core 2 is configured cylindrically continuously to the free end 4. In order for a conical tapering of the envelope towards the free end 4 to be ensured, the undulated application organs 5 are cut conically towards the free end 4, and thus shortened along their longitudinal axis M. Such a shortening can take place subsequent to an injection-molding process by cutting or grinding. However, it may also be provided to provide the shortened extent of the application organs 5 towards the free end 4 in the injection mold, i.e. already in the primary forming mold.

Figure 5:
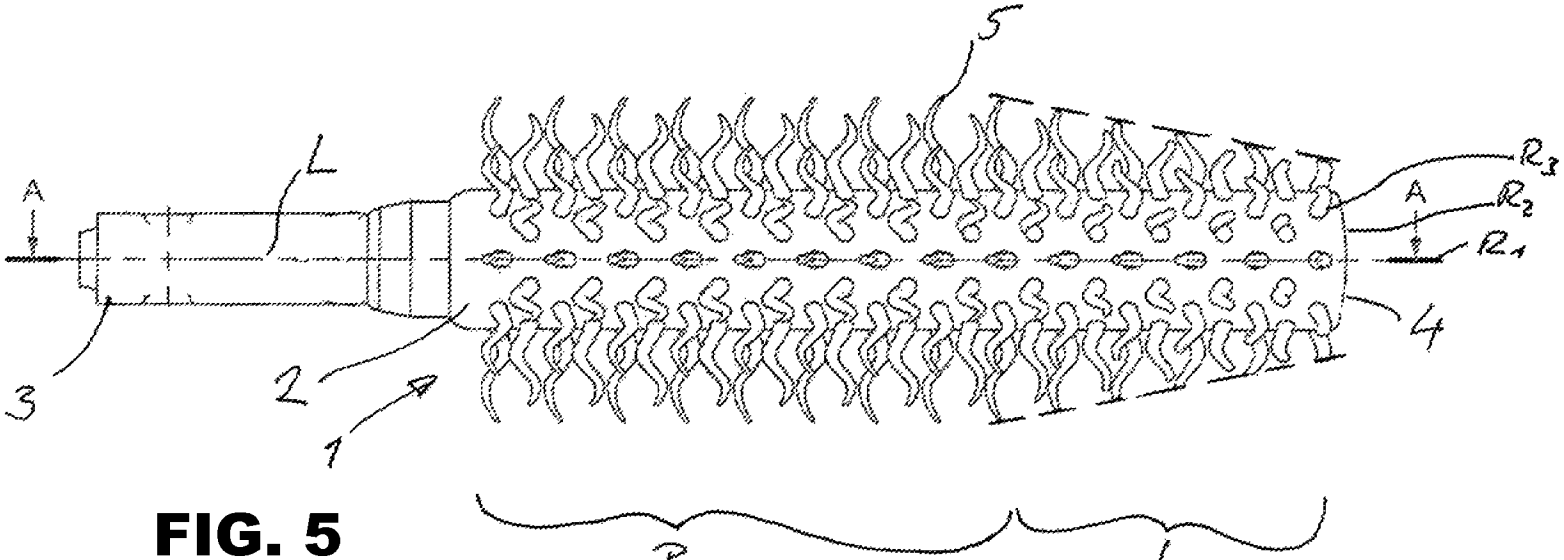
FIG. 5 shows a fourth embodiment of the applicator device according to the invention in a top view.
Figure 5A:
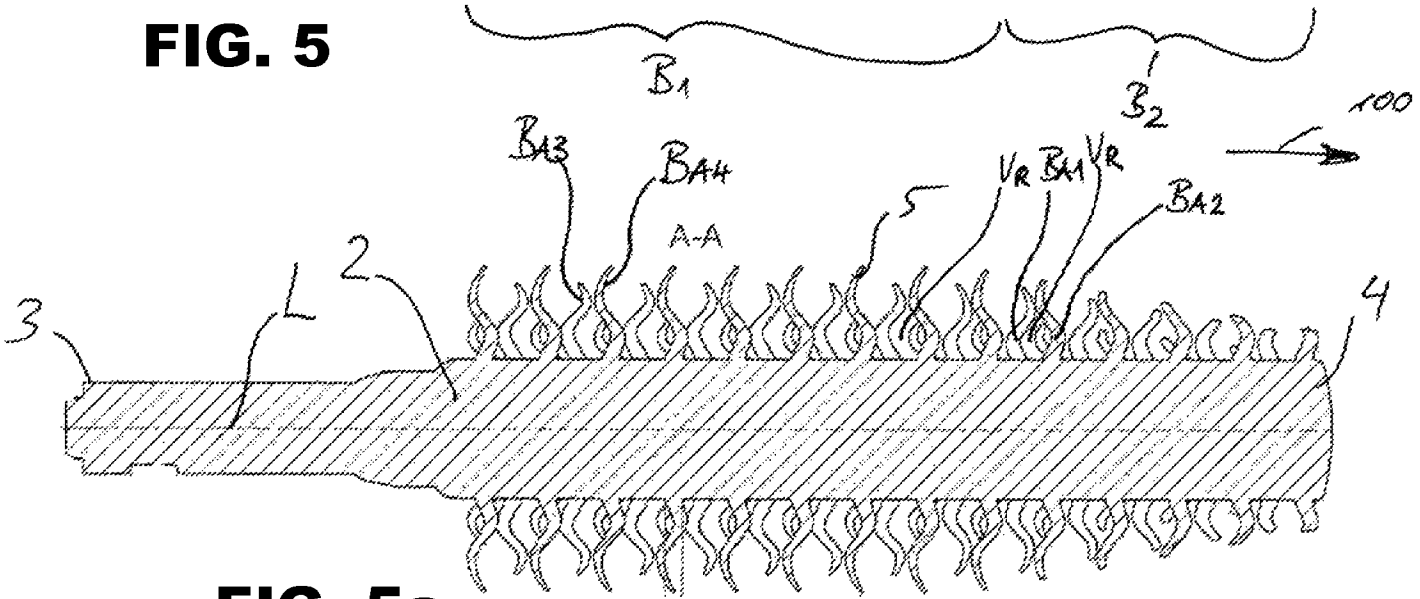
FIG. 5*a* shows the embodiment according to FIG. 5 in a longitudinal sectional view along the line A-A from FIG. 5.

FIGS. 5 and 5*a* show another embodiment of the applicator device according to the invention. This applicator device is based on a basic arrangement of the application organs 5 in accordance with the FIGS. 4 and 4*a*. Also in this case, the application organs 5 are configured shortened towards the free end 4. A core that has a cylindrical profile over the entire length of the bristle covering $l_1+l_2$ is used. Compared with an applicator according to FIG. 4, the application organs 5 of adjacent rows $R_1$, $R_2$, $R_3$ are each disposed rotated by 180° relative to one another, so that the application organs 5 of a row $R_1$ depart from a top side of the core 2 in the direction towards the free end 4, and their bristle ends 8 also point towards the free end 4. Application organs 5 of an adjacent row $R_2$ are arranged exactly the other way round and depart from the top side of the core 2 in the direction towards the proximal end 3. Their free bristle ends 8 also point towards the proximal end 3. Reservoir volumes $V_R$ are thus formed in the area of a core 2. The reservoir volumes $V_R$ are in this case surrounded by convexly curved bristle sections $B_{A1}$, which are directed away from one another, of adjacent bristles 5, with these areas $B_{A1}$ and $B_{A2}$ belonging to bristles of adjacent rows $R_1$, $R_2$, $R_3$.

Areas $B_{A3}$ and $B_{A4}$, which are concavely curved towards each other, of adjacent bristles 5 are located outside the respective points of inflection W or areas of inflection and thus form, seen in a side view according to FIGS. 5, 5*a*, a pincer-like eyelash capturing and/or bundling device that is open in a funnel shape. A good all-round wetting of the eyelashes over 360°, in particular, is thus accomplished so that a good transfer of mascara mass onto the eyelashes or bundles of eyelashes takes place.

With regard to their geometrical three-dimensional shape, the bristles of adjacent rows $R_1$ and $R_2$ are preferably configured identically and only disposed on the core 2 offset by 180° relative to the longitudinal direction 100. Of course, the scope of the invention also includes configuring the geometrical three-dimensional shape of the application organs of adjacent rows $R_1$ and $R_2$ in a different way.

Figure 6:
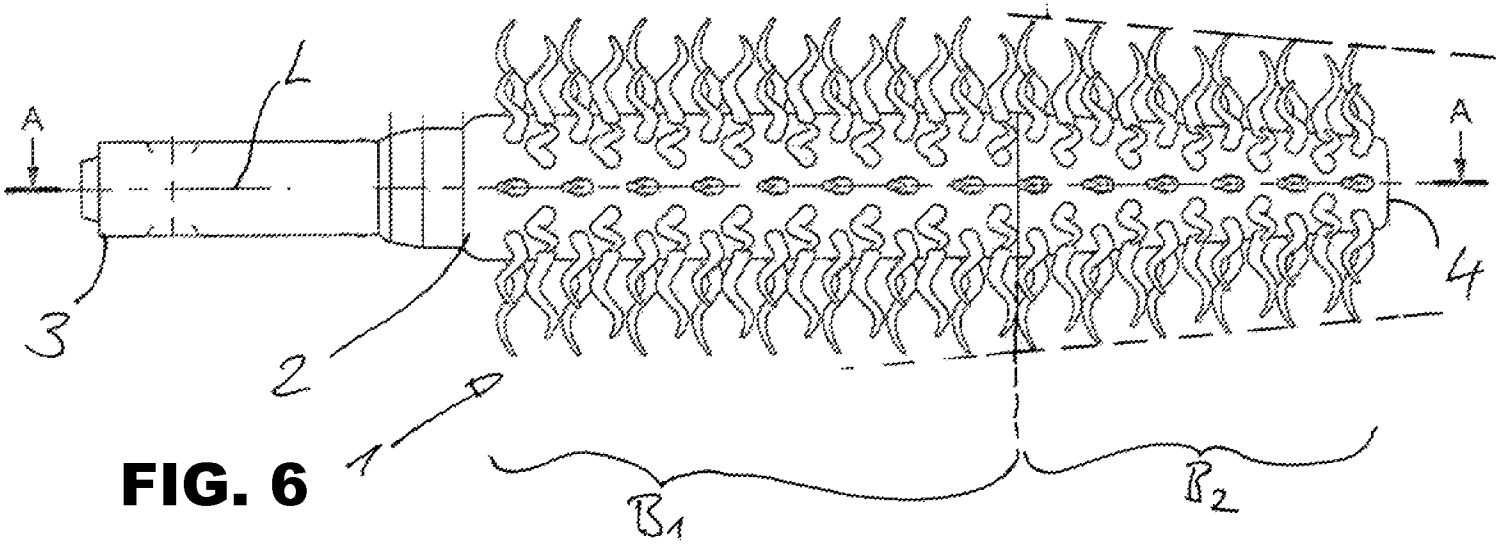
FIG. 6 shows a fifth embodiment of the applicator device according to the invention in a top view.
Figure 6A:
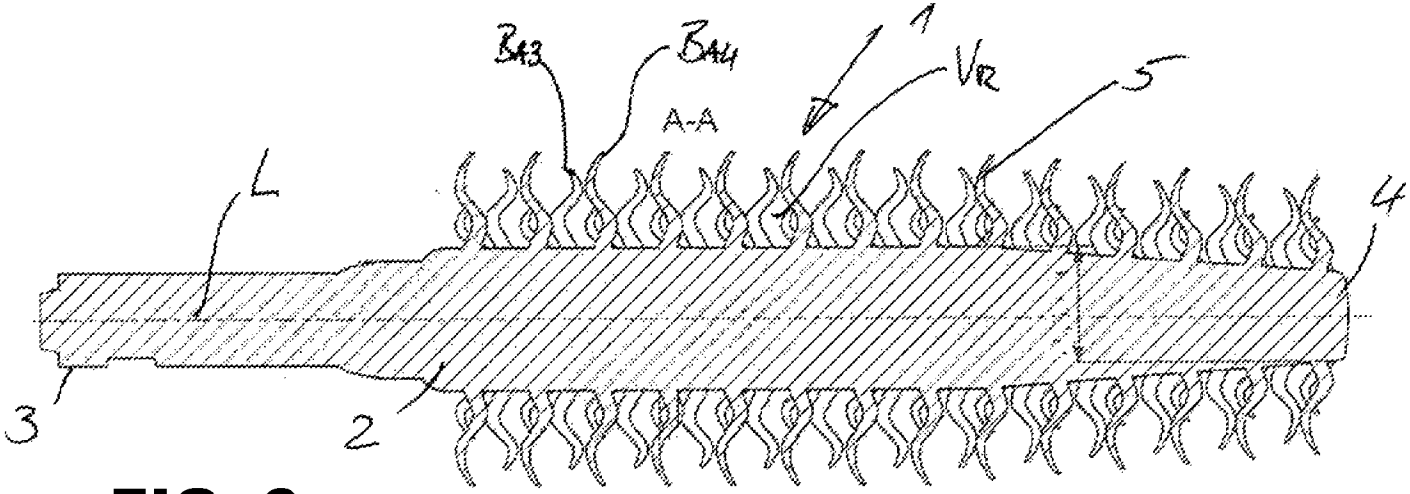
FIG. 6*a* shows the embodiment according to FIG. 6 in a longitudinal sectional view along the line A-A from FIG. 6.
Figure 7:
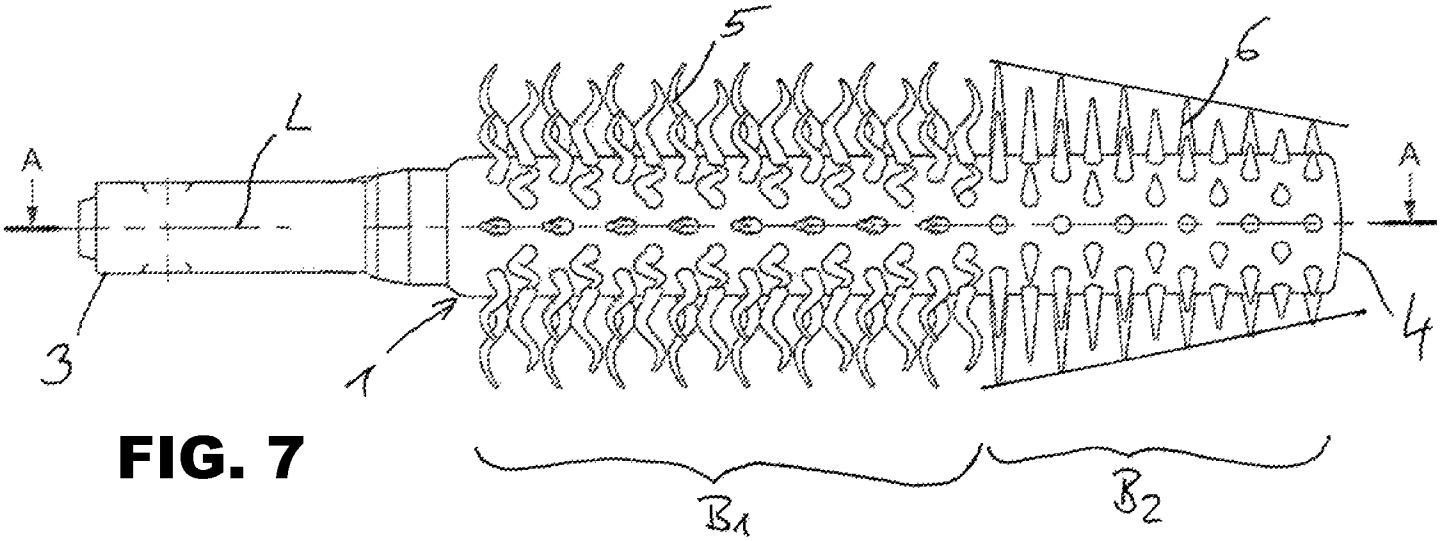
FIG. 7 shows a sixth embodiment of the applicator device according to the invention in a top view.
Figure 7A:
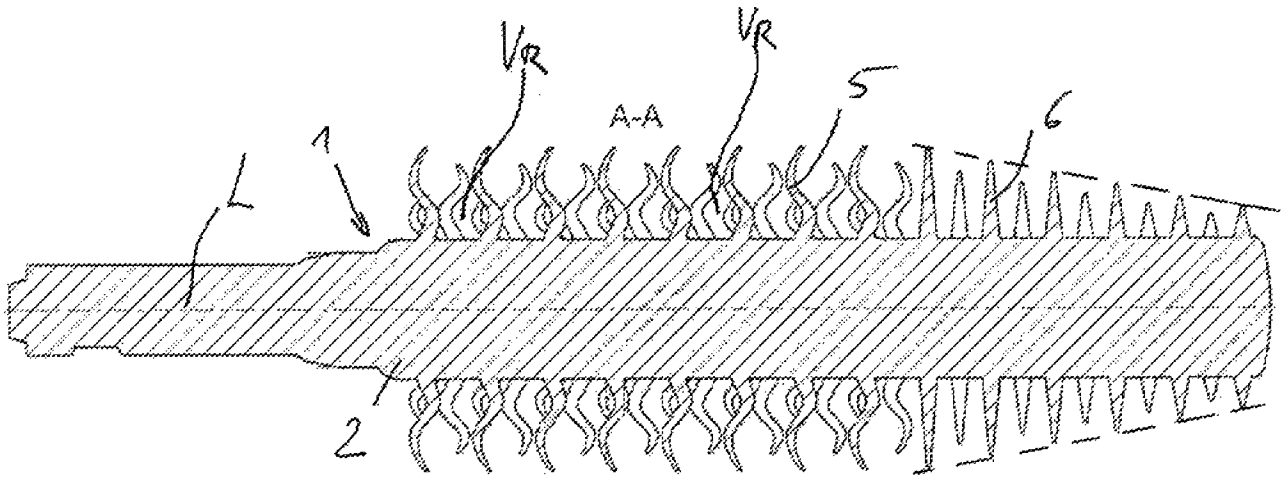
FIG. 7*a* shows the embodiment according to FIG. 7 in a longitudinal sectional view along the line A-A from FIG. 7.

According to another embodiment of the applicator device according to the invention (FIGS. 6 and 6*a*), such an applicator device 1 again comprises a cylindrical core 2 in the area $B_1$ and a core 2 which conically tapers towards the free end 4 in the area $B_2$. The covering of the areas $B_1$ and $B_2$ with application organs corresponds to that of the above-described example according to the FIGS. 5, 5*a*. Thus, application organs 5 of adjacent rows $R_1$ and $R_2$ are respectively disposed on the core 2 in opposite alignments relative to the longitudinal direction 100.

Another embodiment (FIGS. 7, 7*a*) of the applicator device 1 according to the invention combines, in the area $B_1$, the bristle covering according to the embodiments 5 and/or 6 with the bristle covering in the area $B_2$ of the embodiment according to FIG. 1.

Of course, the free ends 4 (distal ends) can have a bristle covering/covering with application organs on the free end face in all of the previously described embodiments, in contrast to those embodiments that were already illustrated and described. Such application organs can of course also comprise the above-described undulation which is essential to the invention. This application organ covering at the end face of the distal end 4 can of course be realized also with already known application organs of other geometrical three-dimensional shapes.

The variety of embodiments makes clear that fundamentally different areas $B_1$ and $B_2$ can be provided in the longitudinal direction which have different application organ coverings. For example, application organs in the form of discs, disc segments, furrows and the like may also be provided for the type 2 instead of conically tapering pointed bristles 6. It is equally possible to cover the sequence of the rows $R_I$, $R_{II}$, $R_{III}$ in the circumferential direction U with different application organs 5, 6. For example, a row I may consist of undulated application organs 5, whereas an adjacent row II consists, for example, of a serrated or otherwise comb-like web. Moreover, application organs may be provided in row II which form conical, pointed-conical or cylindrical bristles. These application organs may also be varied among one another.

What is characteristic for the invention is that an applicator device according to the invention comprises at least one application organ 5 with an undulation. The covering of the other applicator devices may be covered with application organs of another type. A variety of such types of application organs are known from the prior art. Known representative examples therefor include cylindrical, conical bristles, discs, disc segments, furrows or the like. Particularly preferably, these application organs are also integrally connected to the core 2, if possible, so that the applicator device 1 can be produced by means of a primary forming process, in particular by means of, for example, a plastic injection molding process (also 2- or multi-component method), as well as by means of a three-dimensional printing process.

The invention claimed is:

1. An applicator device, in particular for a mascara applicator, comprising:

a core; and a plurality of application organs extending from the core, each of the application organs having a greater thickness in a base area and tapering toward a free end of the organ and forming an eyelet-like loop at the free end, wherein at least in some portions of the applicator device the application organs are disposed longitudinally in rows, as viewed along a longitudinal axis of the core, and each of the application organs comprises a central axis having at least one undulation with at least one change of curvature with a point of inflection, such that a tangent through the point of inflection forms an angle β with the longitudinal axis of the core, and the angle β is between 25° and 75°, and the central axis of an application organ spans a plane; wherein the undulations of the central axes of application organs of adjacent rows are configured in an inverse manner.

2. The applicator device according to claim 1, wherein the applicator device comprises a first area of the core with application organs of a first type or with a core of a first type and a second area of the core with application organs of a second type or with a core of a second type.

3. The applicator device according to claim 1, wherein the central axes of application organs of one row lie in a common plane and the plane is disposed parallel or substantially parallel to a longitudinal axis of the applicator device.

4. The applicator device according to claim 1, wherein the central axes of application organs of two rows which are opposite from each other relative to the core, lie in a common plane.

5. The applicator device according to claim 1, wherein the undulations of the central axes of the application organs of all undulated application organs is configured identically with regard to an amplitude and/or a wave length.

6. The applicator device according to claim 1, wherein undulated application organs are configured identically with regard to their three-dimensional shape and with regard to their radial extent.

7. The applicator device according to claim 2, wherein, in order to form an applicator which conically tapers towards a free (distal) end of the applicator, the core is configured to taper conically, and comprises in this second area an application organ covering that is identical to the first area.

8. The applicator device according to claim 7, wherein, for the applicator device to be configured conically towards the distal end, the core, in a second area, is configured cylindrically, in particular configured so as to be continued identically to the first area, and that an application organ covering of a second type is provided in the second area that has no undulation, and in which the radial longitudinal extent of the application organs decreases away from the core towards the distal end of the applicator device.

9. The applicator device according to claim 7, wherein, for the applicator device to be configured conically towards the distal end, the core, in the second area, is configured cylindrically, in particular configured so as to be continued identically to the first area, and that an application organ covering of a second type is provided in the second area that has no undulation, or that the application organs of the second area at least partially comprise an undulation corresponding to the undulation of the application organs in the first area, wherein the application organs in the second area are shortened with regard to their longitudinal extent.

10. The applicator device according to claim 1, wherein the application organs of a first row are disposed offset relative to application organs of adjacent rows in the longitudinal direction of the applicator, in particular disposed offset in such a way that the application elements of the one row are disposed approximately centrally between free gaps of two application organs of an adjacent row.

11. The applicator device according to claim 2, wherein the application organs of the first area have an undulation and the application organs of the second area are not undulated but curved once.

12. The applicator device according to claim 1, wherein the application organs are formed from a different, in particular softer, plastic than the core.

13. The applicator device according to claim 1, wherein tangents on the central axes of undulated application organs include at the base of the application organ an angle ($\alpha$) to the longitudinal axis of the applicator, where: $30° \leq \alpha < 90°$.

14. The applicator device according to claim 13, wherein, in the undulated application organs, tangents, in a point of inflection of the central axis, include an angle ($\beta$ or an angle $\beta'$) to the longitudinal axis of the applicator, where:

$$25° \leq \beta \leq 75°, \text{ or}$$

$$0° \leq \beta' \leq 90°, \text{ or}$$

$$\alpha \neq \beta \text{ or } \alpha \neq \beta'$$

$$\beta < \alpha \text{ or } \beta' < \alpha.$$

15. The applicator device according to claim 1, wherein corresponding application organ pairs are disposed in a circumferential direction around the core of the applicator device in rows, with an imaginary central plane between the application organs forming the respectively corresponding application organ pairs standing perpendicularly on the longitudinal axis of the applicator.

16. An applicator, in particular for applying a cosmetic with the applicator device according to claim 1.

17. An application unit, in particular a cosmetics unit, comprising at least one applicator device according to claim 1.

* * * * *